US005317779A

United States Patent [19]

Hoagland

[11] Patent Number: 5,317,779

[45] Date of Patent: Jun. 7, 1994

[54] UTILITY KITCHEN BRUSH

[75] Inventor: Mary M. Hoagland, Cincinnati, Ohio

[73] Assignee: Vining Industries, Inc., Springfield, Ohio

[21] Appl. No.: 2,919

[22] Filed: Jan. 11, 1993

[51] Int. Cl.[5] ..... A47L 13/12

[52] U.S. Cl. ..... 15/111; 15/236.05; 15/105

[58] Field of Search ..... 15/111, 236.01, 236.05, 15/236.06, 105; 81/20; 30/169, 172; D8/75

[56] References Cited

U.S. PATENT DOCUMENTS

| | | | |
|---|---|---|---|
| D. 199,177 | 9/1964 | Kennedy | D9/2 |
| D. 203,026 | 11/1965 | Vallis | D9/2 |
| D. 227,621 | 7/1973 | Lindbo et al. | D4/2 |
| D. 231,283 | 4/1974 | Lindbo et al. | D4/1 |
| D. 241,091 | 8/1976 | Ahlstrom et al. | D4/1 |
| D. 257,521 | 11/1980 | Piero | D4/6 |
| D. 307,077 | 4/1990 | Bryant | D4/118 |
| D. 308,139 | 5/1990 | Viner | D4/118 |
| D. 308,140 | 5/1990 | Klamm | D4/118 |
| D. 316,634 | 5/1991 | Vetter | D4/116 |
| 1,517,043 | 11/1924 | Benson | 81/20 |
| 2,420,120 | 5/1947 | Bruchsaler | 81/20 |
| 2,517,247 | 8/1950 | Seley | 15/105 |
| 2,524,475 | 10/1950 | Renz | 15/105 |
| 2,772,430 | 12/1956 | Moritt | 15/111 |
| 2,792,584 | 5/1957 | Fryda | 15/236 |
| 2,807,814 | 10/1957 | Leeming | 15/111 |
| 2,981,964 | 5/1961 | Downing | 15/236.02 |
| 3,111,698 | 11/1963 | Reichle | 15/105 |
| 3,203.118 | 8/1965 | Bonic | 15/236.01 |
| 4,176,417 | 12/1979 | Ruff | 15/105 |
| 5,060,337 | 10/1991 | Niekerk | 15/111 |

*Primary Examiner*—Philip R. Coe
*Assistant Examiner*—Reginald L. Alexander
*Attorney, Agent, or Firm*—Panitch Schwarze Jacobs & Nadel

[57] ABSTRACT

A utility brush for use in the kitchen to clean such items as pots, pans, utensils, dishes, sinks and plastic storage and serving vessels. The brush comprises a substantially rectangular bristle block with an array of bristles extending downwardly from its bottom surface. A gently curved handle extends upwardly and rearwardly from the central and rearward portion of the bristle block top enabling scrubbing power to be applied to the center of the bristle block and thus to the entire array of bristles. A first scraper extends upwardly and forwardly from the bristle block top surface along the bristle block forward edge from a first forward corner of the bristle block toward the second forward bristle block corner, terminating short thereof. A second upstanding tooth-like scraper is located at the second bristle block forward corner. The second scraper is narrower along the bristle block forward edge than along the adjacent bristle block side edge. The first and second scrapers define a notch therebetween. The first scraper can be used on exterior and flat surfaces. The base of the notch can be used to scrape edges and rims of pots, pans, skillets, lids and the like. The second scraper can be used to clean interior vessel wall surfaces, corners and crevices, as well as grooves of the type found in plastic storage container lids.

10 Claims, 2 Drawing Sheets

UTILITY KITCHEN BRUSH

TECHNICAL FIELD

The invention relates to a utility brush for use in the kitchen to scrub such items as pots, pans, utensils, sinks, dishes, plastic storage and serving vessels, and the like, and more particularly to such a brush having a unique scraper arrangement on its bristle block.

BACKGROUND ART

Prior art workers have developed many types of kitchen brushes provided with elongated handles and having some form of scraper in association therewith. U.S. De. Pat. Nos. De. 203,026; De. 231,283 and De. 307,077 are exemplary of such brushes. Scraper provided brushes are also taught in U.S. Pat. Nos. 2,792,584 and 2,807,814.

Many such prior art brushes, however, are characterized by complex structure and the fact that they must be handled with some care since the scrapers thereon are somewhat hazardous. The present invention is based upon the development of a hand held scrub brush for use in the kitchen on items such as pots, pans, utensils, sinks, dishes, and plastic storage and serving utensils, which brush is provided with a unique scraper arrangement. The scraper arrangement is not hazardous and does not cause the brush to require special handling. On the other hand, the scraper arrangement provides a versatility of use hitherto unavailable.

The scraper arrangement of the present invention is capable of scraping exterior and flat surfaces, as well as interior surfaces. Interior corners and crevices can also be scraped, as well as the grooves of the type found in the lids of plastic storage and serving vessels. The scraper arrangement of the present invention also enables the cleaning of pot and skillet rims, lid rims and the like.

The brush of the present invention is provided with an elongated handle which transmits scrubbing power to the center of the bristle block, and therefore, to the entire array of bristles extending therefrom. The handle is provided with anti-slip means facilitating the normal push-pull action of a scrubbing operation.

DISCLOSURE OF THE INVENTION

According to the invention, there is provided a utility brush intended primarily for use in the kitchen to clean pots, pans, utensils, dishes, sinks, plastic storage and serving vessels, and other kitchen items normally requiring scrubbing. The brush comprises a bristle block having forward and rearward ends, sides, and top and bottom surfaces. An array of bristles extends downwardly from the bottom surface of the bristle block. Any appropriate type of bristle may be used.

A slightly curved, elongated handle extends upwardly and rearwardly from the central and rearward portion of the bristle block top surface. That portion of the handle near its free end constitutes a grip. The handle is so designed as to transmit scrubbing forces to the center of the bristle block, and thus to the entire array of bristles dependent therefrom.

The top surface of the bristle block near the forward end thereof is provided with a first upwardly and forwardly directed scraper having a forward facing scraping edge. This first scraper extends along the forward end of the bristle block from a first forward corner thereof toward its second forward corner. A second upstanding, tooth-like scraper is located at the second bristle block forward corner. The second scraper has a narrower transverse dimension along the forward end of the bristle block and a wider transverse dimension along the adjacent bristle block side. The first and second scrapers define between them a notch. The first scraper is configured to clean exterior and flat surfaces. The wide transverse dimension of the second scraper enables it to clean inside surfaces and the like. The narrow transverse dimension of the second scraper enables it to clean crevices, inside corners, and the grooves of plastic ware lids. The groove between the first and second scrapers is wider at its open end than at its base. The base of the groove and the facing surfaces of the first and second scrapers enable the scraping and cleaning of the rims of lids, pots, skillets and the like. The elongated handle of the brush, allows the brush to be held in various orientations to accomplish the various types of scraping operations which can be performed by the brush.

DETAILED DESCRIPTION OF THE INVENTION

Figure 1:
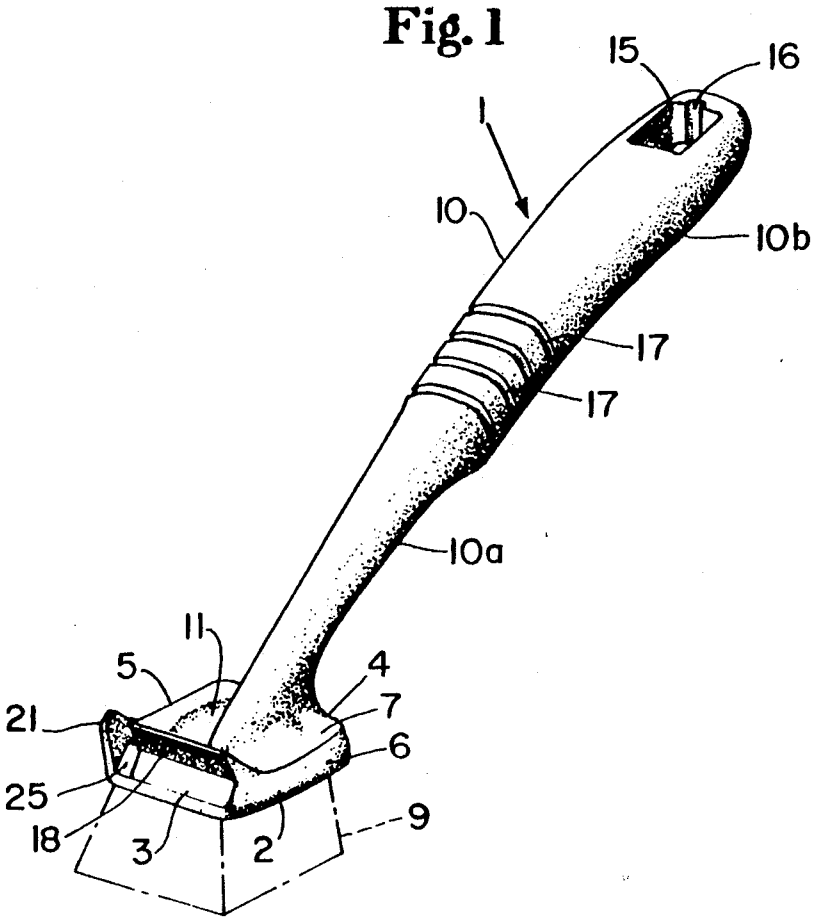
FIG. 1 is a top, front and left side perspective view of the brush of the present invention with its bristles indicated by broken lines.
Figure 2:
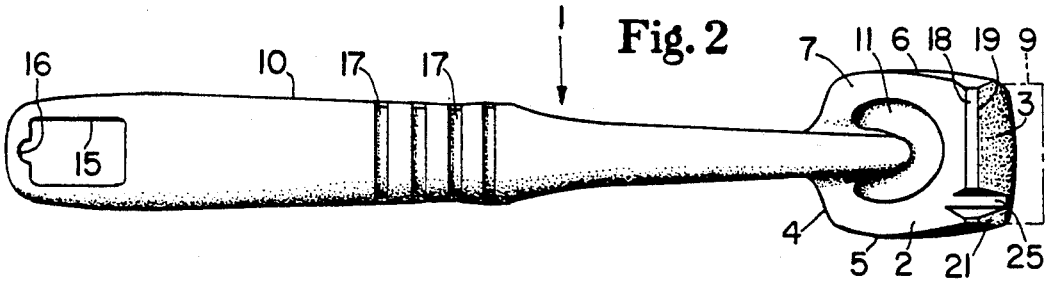
FIG. 2 is a plan view of the brush of FIG. 1 with its bristles shown by broken lines.

In all of the Figures, like parts have been given like index numerals. The brush of the present invention is generally indicated at 1 and comprises a substantially rectangular bristle block 2 having a forward end 3, a rearward end 4, sides 5 and 6, a top surface 7 and a bottom surface 8. While not a limitation of the invention, the bottom surface 8 is illustrated as being slightly domed. A conventional bristle array depends downwardly from the bottom surface 8 and is indicated in the Figures by broken lines at 9. The above noted domed configuration of the bristle bottom surface causes the bristle array 9 to be slightly flaired.

The brush 1 is provided with a handle 10. The handle 10 joins the bristle block 2 at the central and rearward portions of its top surface 7. This assures that a scrubbing force manually applied to the handle 10 will be directed to the center of the bristle block and thus to the entire array of bristles 9. The top surface 7 of the bristle block is provided with a shallow central U-shaped depression 11 about the handle 1.

Figure 4:
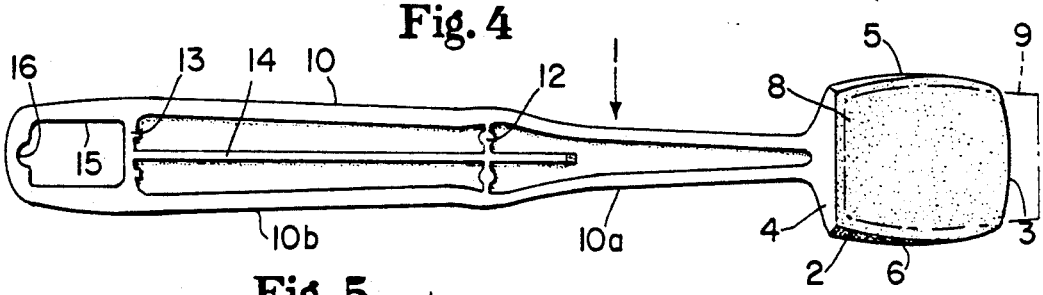
FIG. 4 is a bottom view of the brush of FIG. 1 with the bristles indicated by broken lines.

The elongated handle 10 is made up of a first shank portion 10*a* and a second grip portion 10*b*. Throughout the majority of its length, the handle 10 is hollow, having a substantially inverted U-shaped cross-section and being reinforced by transverse ribs 12 and 13, and a longitudinal rib 14 (see FIG. 4). The longitudinal rub 14 gives the user a full grip feeling when the handle 10 is grasped.

Figure 3:
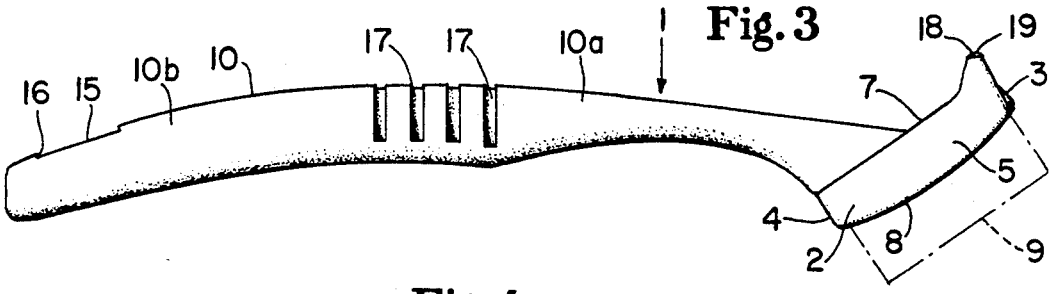
FIG. 3 is a right side elevational view of the brush of FIG. 1 with its bristles indicated by broken lines.

As perhaps can best be seen in FIG. 3, the handle 10 has a gentle, longitudinal curve. The bottom edges of the grip portion 10*b* of handle 10 are substantially correspondingly curved. The bottom edges of the shank portion 10*a* of handle 10, however, have a more pronounced curve. The handle shank portion 10*a* is narrower from side to side near the bristle block 2 than it is at its juncture with the grip portion 10*b*. The grip portion 10*b* is provided with a rectangular perforation 15, provided at its rearwardmost end with a notch 16. The perforation 15 and notch 16 enable the brush to be suspended on a display rack, or from a nail or hook in the kitchen, when not in use. The grip portion 10*b* is provided with a series of transversely extending grooves 17 near the juncture of the grip portion 10*b* and the shank portion 10*a*. This grooved area of the grip portion 10*b* constitutes a thumb rest area and the grooves provide a good push-pull grip during a scrubbing operation. The grip portion 10*b* may also be provided with a textured surface (not shown) to enhance a frictional engagement of the handle by the user's hand. Such a textured surface, as well as the grooves 17, will provide an easier grip when the user's hands are soapy or greasy. They will also serve to prevent the user's hand from slipping down the handle and they will enable better control of the brush 1 and the provision of greater pressure with less work.

Figure 5:
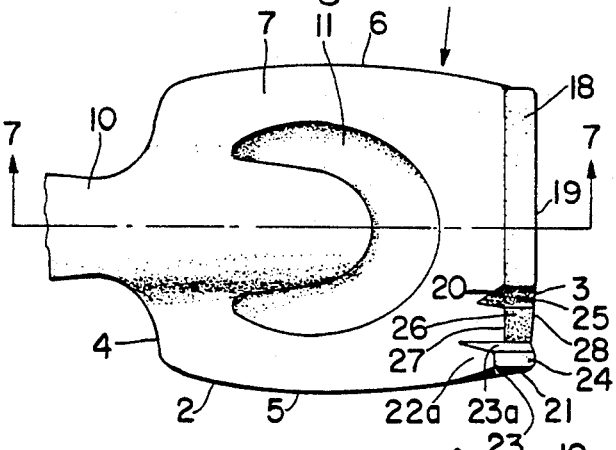
FIG. 5 is a fragmentary, enlarged, plan view of the bristle block of the brush of FIG. 1.
Figure 6:
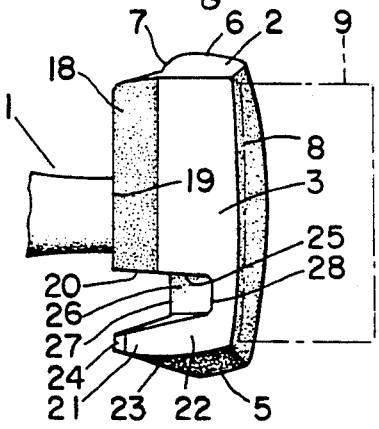
FIG. 6 is a fragmentary, enlarged, front view of the bristle block of FIG. 5 with the bristles shown by broken lines.
Figure 7:
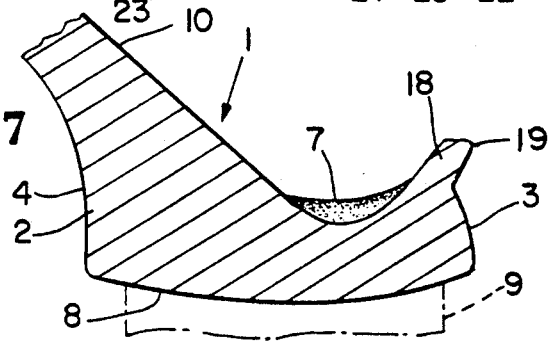
FIG. 7 is a fragmentary, enlarged, cross-sectional view taken along section line 7—7 of FIG. 5, again with the bristles shown in broken lines.

The bristle block 2, at its forward end 3, is provided with a first scraper 18. The first scraper 18 extends forwardly and upwardly from the top surface 7 of bristle block 2 (see FIG. 7). The first scraper 18 provides a substantially rectilinear forward scraping edge 19. While the scraping edge 19 is sharp enough to perform a scraping operation, it is slightly radius, as are all of the edges of scraper 18, so as not to constitute a hazard to the user. The first scraper 18 extends from a first forward corner of the bristle block 2 toward the second forward corner thereof, but terminates in an end surface 20 short of the second forward corner of the bristle block. At the second forward corner of the bristle block, an upstanding, tooth-like, second scraper 21 is located. As is most clearly shown in FIGS. 1, 5 and 6, the second scraper 21 has a forward surface 22 which is narrower than its side surface 23. The second scraper has a curved rear scraping surface 22*a* opposite its forward surface 22 and a side surface 23*a* opposite its side surface 23. The second scraper has a top surface 24. The top surface 24 is substantially rectangular and slopes slightly downwardly and forwardly. This enables the brush to be held upside down so that the second scraper 21 can be inserted in grooves such as those found in plastic ware lids. The edges of top surface 24 all constitute scraping edges. The vertical edges between second scraper surfaces 22–23, 23–22*a*, 22*a*–23*a*, and 23*a*–22 are all acraping edges. As in the case of the first scraper 18, all of the edges of the second scraper 21 are slightly radius so as not to represent a hazard to the user.

The first and second scrapers 18 and 21, being spaced from each other, define a notch 25. The notch 25 has a base surface 26 which extends downwardly and forwardly from the top surface 7 of the bristle block 2. The juncture of the notch base surface 26 and the top surface 7 of the bristle block forms a scraping edge 27. Similarly, the juncture of the notch base surface 26 and the forward surface 3 of the bristle block forms a second scraping edge 28. It will be apparent from FIGS. 5 and 6, for example, that the notch 25 is wider at its top than at its base surface 26.

The forward scraping edge 19 of the first scraper 18 is suitable for scraping external surfaces of vessels, utensils and the like, as well as both exterior and interior planar surfaces thereof. The tooth-like second scraper 21 provides a number of surfaces and edges for scraping crevices and inside corners of vessels, and the like. The juncture of the surfaces 22 and 23 of second scraper 21 presents an excellent scraping edge for the inside surfaces of vessels. The entire upper end 24 and its four edges constitute an excellent and effective scraper for grooves and channels such as those commonly formed in the lids of plastic or rubber storage or serving vessels. The presence of the notch 25, of course, assists in the insertion of the second scraper 21 into grooves or channels. While not constituting a limitation on the present invention, excellent results in the cleaning of crevices and grooves have been achieved when the top surface 24 of the second scraper has a width of about 0.061 inches. The curved scraping surface 22*a* also assists in cleaning channels and grooves.

The edges 27 and 28 of the groove 25 can be used to advantage to scrape the upper rims of pots, skillets and the like and the outer rims of lids, etc. Again, while not intended to be a limitation of the present invention, excellent results have been achieved with a notch 25 having a base width of about 0.123 inch and an upper width of about 0.30 inch.

From the above, it will be noted that the combination of the first scraper 18, the second scraper 21 and the notch 25 therebetween enable a large number of scraping actions on a multitude of surface configurations. This versatility adds markedly to the cleaning abilities of the brush 1. If the brush 1 of the present invention is intended primarily for use with metallic pots and pans, and other metal surfaces, the brush may be provided with brass bristles 9. If it is intended primarily for use with sinks, dishes, plastic and rubber storage and serving vessels and the like, the bristles 9 may be made of nylon or other appropriate material.

It will be apparent to one skilled in the art that the bristle block 2, the handle 10 and the scrapers 18 and 21 lend themselves well to be molded as a single, integral, one-piece structure.

Modifications may be made in the invention without departing from the spirit of it. For example, it would be within the scope of the invention to reverse the positions of the first scraper 18 and the second scraper 21. This, in turn, would shift the position of the notch 25. These various elements, however, would perform their tasks in the same manner.

As used herein and in the claims, words such as "forward", "rearward", top", and "bottom" are used for purposes of clarity in conjunction with the drawings. It will be appreciated that the brush can be held in any appropriate orientation during scrubbing or scraping operations.

What is claimed:

1. A utility brush comprising a substantially rectangular bristle block having side edges, front and rear edges, top and bottom surfaces, and first and second forward corners, an array of bristles extending from said bottom surface, a first scraper extending upwardly and forwardly from said bristle block top surface and along said bristle block forward edge from said first forward corner toward said second forward corner, said first scraper terminating short of said second forward corner, said first scraper having a forwardly directed scraping edge thereon, a second upstanding, scraper being located at said second forward corner, said first and second scrapers having facing surfaces defining a notch between them.

2. The brush claimed in claim 1 wherein said notch has a base surface, said scraper surfaces defining said notch sloping downwardly and toward each other to said base surface, said notch base surface sloping downwardly and forwardly from said top surface to said forward edge of said bristle block, scraping edges being formed at the junctures of said notch base surface and said top surface and forward edge of said bristle block.

3. The brush claimed in claim 1 wherein said second scraper has a first side surface along the adjacent bristle block side, a front surface, a second side surface partially defining said notch and a longitudinally curved rearward surface, said first and second side surfaces being wider than said forward and rearward surfaces, said second scraper terminating in a substantially rectangular top surface which slopes slightly downwardly and forwardly, said top surface having forward, rearward and side edges comprising scraping edges, adjacent ones of said side, forward and rearward edges of said second scraper forming substantially vertical scraping edges therebetween.

4. The brush claimed in claim 1 including a handle extending upwardly and rearwardly from the central and rearward portions of said top surface of said bristle block.

5. The brush claimed in claim 2 wherein said second scraper has a first side surface along the adjacent bristle block side, a front surface, a second side surface partially defining said notch and a longitudinally curved rearward surface, said first and second side surfaces being wider than said forward and rearward surfaces, said second scraper terminating in a substantially rectangular top surface which slopes slightly downwardly and forwardly, said top surface having forward, rearward and side edges comprising scraping edges, adjacent ones of said side, forward and rearward edges of said second scraper forming substantially vertical scraping edges therebetween.

6. The brush claimed in claim 5 including a handle extending upwardly and rearwardly from the central and rearward portions of said top surface of said bristle block.

7. The brush claimed in claim 4 wherein said handle has a gentle longitudinal curve, said handle having a shank portion attached to said bristle block and terminating in a grip portion, and a plurality of transverse anti-slip grooves formed in said handle at the juncture of shank and grip portions.

8. The brush claimed in claim 6 wherein said handle has a gentle longitudinal curve, said handle having a shank portion attached to said bristle block and terminating in a grip portion, and a plurality of transverse anti-slip grooves formed in said handle at the juncture of shank and grip portions.

9. The brush claimed in claim 7 wherein said handle is hollow for most of its length, having an inverted U-shaped cross-section, at least one transverse reinforcing rib and a longitudinal reinforcing rib within said handle, said longitudinal rib being so sized and positioned as to give the user a full, non-hollow handle feel.

10. The brush claimed in claim 8 wherein said handle is hollow for most of its length, having an inverted U-shaped cross-section, at least one transverse reinforcing rib and a longitudinal reinforcing rib within said handle, said longitudinal rib being so sized and positioned as to give the user a full, non-hollow handle feel

* * * * *